United States Patent [19]

Iwase et al.

[11] Patent Number: 4,613,248

[45] Date of Patent: Sep. 23, 1986

[54] RIBBON LIFT MECHANISM FOR A TYPEWRITER

[75] Inventors: Takayuki Iwase; Tsuneo Ohashi, both of Nagoya, Japan

[73] Assignee: Brother Kogyo Kabushiki Kaisha, Nagoya, Japan

[21] Appl. No.: 659,532

[22] Filed: Oct. 10, 1984

[30] Foreign Application Priority Data

Oct. 19, 1983 [JP] Japan ..... 58-161694[U]

[51] Int. Cl.[4] ..... B41J 11/60; B41J 35/10

[52] U.S. Cl. ..... 400/697.1; 400/240.1; 400/186; 400/216.1

[58] Field of Search ..... 400/56, 144.2, 206, 400/207, 208, 216.1, 240, 240.1, 320, 695, 697, 697.1, 323, 154.4, 186

[56] References Cited

U.S. PATENT DOCUMENTS

| | | | |
|---|---|---|---|
| 4,411,542 | 10/1983 | Wenderoth et al. | 400/697.1 |
| 4,469,458 | 9/1984 | Giolitti | 400/697.1 X |
| 4,472,073 | 9/1984 | Valle et al. | 400/697.1 X |

FOREIGN PATENT DOCUMENTS

| | | | |
|---|---|---|---|
| 48418 | 3/1982 | European Pat. Off. | 400/216.1 |
| 2362697 | 6/1975 | Fed. Rep. of Germany | 400/216.1 |
| 2146595 | 5/1977 | Fed. Rep. of Germany | 400/216.1 |
| 2902487 | 7/1979 | Fed. Rep. of Germany | 400/216.1 |
| 2904489 | 8/1980 | Fed. Rep. of Germany | 400/697.1 |
| 7081 | 1/1984 | Japan | 400/697.1 |
| 12891 | 1/1984 | Japan | 400/697.1 |
| 7413476 | 4/1975 | Netherlands | 400/320 |
| 381472 | 10/1932 | United Kingdom | 400/216.1 |

*Primary Examiner*—Edgar S. Burr
*Assistant Examiner*—James R. McDaniel
*Attorney, Agent, or Firm*—Leydig, Voit & Mayer, Ltd.

[57] ABSTRACT

A typewriter ribbon lifting mechanism includes a holder supporting a printing ribbon and a correction ribbon below the printing ribbon. The holder is vertically tiltable for lifting the printing or correction ribbon selectively from its inoperative position to its operative position. The holder is normally held in its lowered inoperative position. A cam follower is secured to the holder and supports an axially movable follower pin thereon. A ribbon lift cam is rotatable only in one direction to cause the cam follower to tilt the holder vertically. The cam has a first cam groove in which the follower pin is engageable to raise the holder to place the printing ribbon in its operative position, and a second cam groove in which the follower pin is engageable to raise the holder to place the correction ribbon in its operative position. The second cam groove has a portion which forms a part of the first cam groove, while the remaining portion of the second cam groove is greater in depth than the first cam groove. A spring is provided for urging the follower pin into engagement with the bottom of the first or second cam groove. An electromagnet device is provided for effecting the correction of any printing error, and causes the cam follower to raise the follower pin so that the follower pin may be engaged with the second cam groove.

3 Claims, 5 Drawing Figures

RIBBON LIFT MECHANISM FOR A TYPEWRITER

BACKGROUND OF THE INVENTION

Field of the Invention:

This invention relates to a mechanism for lifting a typewriter ribbon.

SUMMARY OF THE INVENTION

It is an object of this invention to provide a novel typewriter ribbon lifting mechanism which is simple in construction and inexpensive to manufacture.

This object is attained by a typewriter ribbon lifting mechanism comprising: a printing ribbon located in front of a platen; a correction ribbon located below the printing ribbon; a holder supporting the printing and correction ribbons, the holder being tiltable to bring the printing and correction ribbons selectively from their inoperative position to their operative position, while the holder is normally held in its inoperative position; a cam follower secured to the holder and supporting a follower pin axially movably; a ribbon lift cam which is rotatable only in one direction to cause the cam follower to tilt the holder, the cam having a first cam groove in which the follower pin is engageable to move the holder to bring the printing ribbon into its operative position, and a second cam groove in which the follower pin is engageable to move the holder to bring the correction ribbon into its operative position, the second cam groove having a portion coinciding with the first cam groove, while the remaining portion of the second cam groove is greater in depth than the first cam groove; means provided on the cam follower for urging the follower pin toward the bottom of the first and second cam grooves; and an electromagnet operable for causing the cam follower to move the follower pin into engagement with the second cam groove to effect the correction of printing.

Other objects of this invention will become apparent from the following detailed description and the appended claims, and a lot of advantages not herein stated will be obvious to anybody of ordinary skill in the art if he carries out this invention.

DETAILED DESCRIPTION OF THE PREFERRED EMBODIMENT

Figure 1:
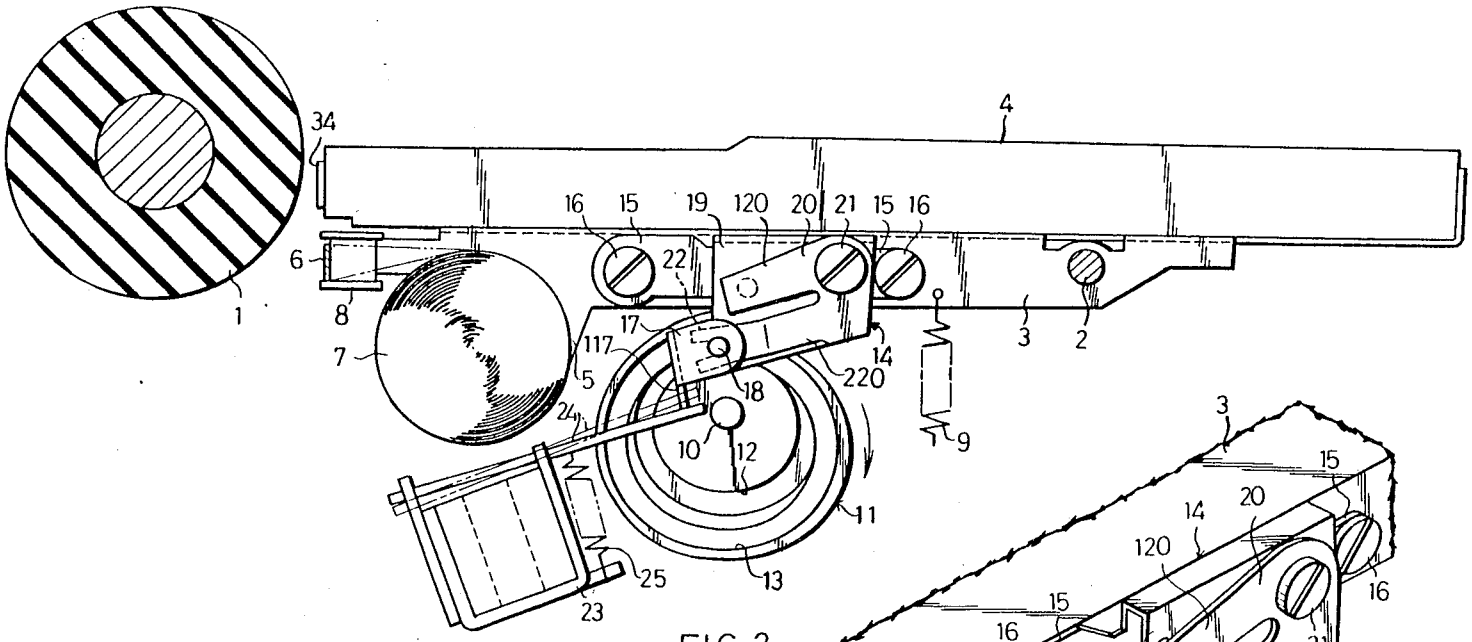
FIG. 1 is a fragmentary side elevational view of a typewriter embodying this invention.

Referring to the drawings in further detail, a typewriter embodying this invention has a platen 1 rotatably supported on a frame and adapted to support printing paper thereon. A carriage not shown is supported on the frame in front of the platen 1 movably along the platen 1. A shaft 2 extending through the carriage and secured thereto supports a holder 3 vertically tiltably at its front end. A ribbon cassette 4 containing a printing ribbon 34 is removably mounted on the holder 3. The printing ribbon 34 has a portion exposed from the cassette 4 and facing the platen 1. A pair of supporting walls 5 depend from the longitudinal edges of the holder 3 (only one of those edges being shown in FIGS. 1 and 2). A supply spool 7 for a correction ribbon 6 is rotatably supported on one of the supporting walls 5, and a take-up spool for the correction ribbon 6, which is not shown, is rotatably supported on the other supporting wall 5. Guide rollers 8 for the correction ribbon 6 are provided at the rear ends of the walls 5.

The correction ribbon 6 is located below the printing ribbon 34 and faces the platen 1.

Figure 4:
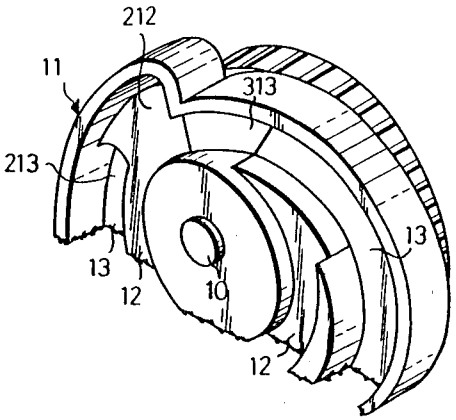
FIG. 4 is a fragmentary enlarged perspective view of the ribbon lift cam showing particularly the configuration of the opposite ends of a pair of cam grooves.
Figure 3:
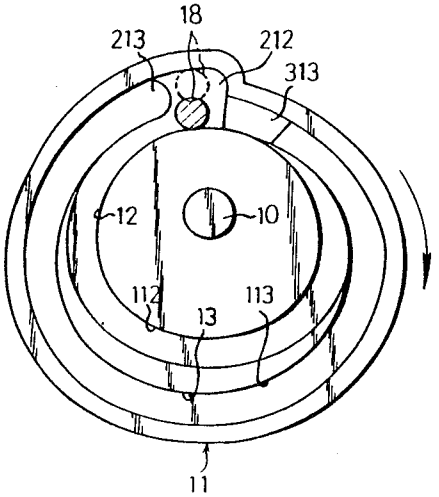
FIG. 3 is an enlarged side elevational view of a ribbon lift cam.

A tension spring 9 is provided behind the shaft 2 and extends between the holder 3 and the carriage to urge the holder 3 into its lower or inoperative position. A shaft 10 is provided in the frame below the holder 3. A ribbon lift cam 11 is rotatably supported on the shaft 10. The cam 11 is rotatable clockwise in FIG. 1 by a drive motor not shown. The cam 11 is provided on one side thereof with a first cam groove 12 which is small in depth and extends along a full circle, as shown in FIG. 3. The cam groove 12 extends from a beginning zone 212 to an ending point, and has a radius which gradually increases from the beginning point 212 and decreases toward the ending point. The cam groove 12 has an intermediate portion 112 of equal radius. The cam 11 also has a second cam groove 13 encircling the first cam groove 12 and extending substantially along a full circle. The second cam groove 13 also extends from a beginning point 213 to an ending point and has a portion of increasing radius which starts at the beginning point 213, an intermediate portion 113 of equal radius and a portion of decreasing radius terminating in the ending point. The first and second cam grooves 12 and 13 have a common ending zone 313, as shown in FIG. 4. The second cam groove 13 is greater in depth than the first cam groove 12, except for the common ending zone 313 which gradually decreases its depth until it becomes contiguous to the beginning zone 212 of the first cam groove 12, as shown in FIG. 4.

Figure 2:
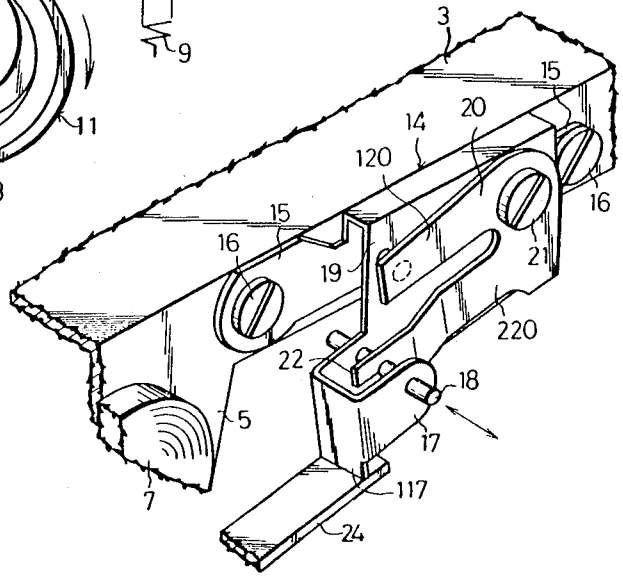
FIG. 2 is a fragmentary enlarged perspective view of FIG. 1 showing particularly the position of a cam follower relative to a holder and the position of a leaf spring relative to the cam follower.

As shown in FIGS. 1 and 2, a cam follower 14, which is formed from a metal sheet, is provided on one side of the holder 3 adjacent to the ribbon lift cam 11 and secured thereto by a pair of screws 16 at its front and rear mounting legs 15. The cam follower 14 has a bent lower end 17 of U-shaped cross section, and a follower pin 18 is axially movably supported on the lower end support 17. The cam follower 14 has a portion 19 connecting the legs 15 and the lower end support 17, and a generally U-shaped leaf spring 20 has a base end secured by a screw 21 to the connecting portion 19. The spring 20 has two arms 120 and 220. The arm 120 has an end secured to the connecting portion 19 and cooperates with the screw 21 to hold the spring 20 in position. The other arm 220 has a bifurcate end 22 holding the follower pin 18 within the support 17. The spring 20 urges the follower pin 18 into engagement with the bottom of the cam grooves 12 and 13. A downward projection 117 depends from the support 17.

An electromagnet 23 is provided behind the ribbon lift cam 11, as shown in FIG. 1. An armature 24 is vertically rotatably supported on the electromagnet 23, and has one end engaging the downward projection 117 of the cam follower 14. A tension spring 25 is provided for urging the armature 24 away from the projection 117.

Prior to the placement of the typewriter in operation, the electromagnet 23 is held in its unenergized position, and the armature 24 is, therefore, held by the spring 25 in its position shown by solid lines in FIG. 1. The ribbon lift cam 11 is out of operation, and the follower pin 18 is kept in its home position shown by a solid line in FIG. 3, as it is held in contact with the inner periphery of the beginning zone 212 of the first cam groove 12 by the spring 9 and in contact with the bottom of the groove by the spring 20. The engagement of the follower pin 18 with the first cam groove 12 maintains the holder 3 in its inoperative position as shown in FIG. 1 and thereby the printing and correction ribbons 34 and 6 on the holder 3 in their respective inoperative positions.

If a letter key is depressed, the drive motor not shown is rotated to rotate the ribbon lift cam 11 clockwise in FIG. 1. If the cam 11 is rotated by a certain angle, it causes the follower pin 18 and the cam follower 14 to tilt the holder 3 upwardly about the shaft 2 against the force of the spring 9 to bring the printing ribbon 34 into its lifted printing position in which it faces the platen 1. The printing head not shown effects printing on the printing paper on the platen 1 when the follower pin 18 stays in the intermediate portion 112 of equal radius of the first cam groove 12.

A ribbon winding mechanism not shown is, then, placed in operation to wind the used portion of the printing ribbon 34 on a take-up spool. As the cam 11 is rotated by a certain angle after the printing operation, the follower pin 18 is moved down along the first cam groove 12 and the holder 3 is, therefore, tilted downwardly to return the printing ribbon 34 to its lowered inoperative position as shown in FIG. 1.

If any printing error has occurred, a back space key is depressed to position the carriage not shown and the holder 3 as required for correcting the error. A correction key is depressed and the key for the erroneously written letter is depressed to energize the electromagnet 23. The rear end of the armature 24 is attracted by the electromagnet 23 and the opposite end thereof is, therefore, raised to its position shown by a chain lines in FIG. 1 by overcoming the force of the spring 25.

The raised end of the armature 24 engages the projection 117 of the cam follower 14 and thereby tilts the holder 3 upwardly against the force of the spring 9. As a result, the follower pin 18 in the beginning zone 212 of the first cam groove 12 is raised to its position shown by a chain line in FIG. 3.

The cam 11 is, then, rotated clockwise in FIGS. 1 and 3, and upon arrival of the follower pin 18 at the beginning end 213 of the second cam groove 13, the spring 20 urges the follower pin 18 against the bottom of the second cam groove 13 so that the inner end of the pin 18 may engage the bottom of the groove 13. Upon rotation of the cam 11 by an angle of about 10°, the electromagnet 23 is deenergized and the armature 24 is brought back by the spring 25 to its lower position away from the projection 117 as shown by solid lines in FIG. 1. There is, however, no fear of the follower pin 18 entering the first cam groove 12, since it is engaged in the second cam groove 13 of greater depth.

As the cam 11 is further rotated, the follower pin 18 is moved upwardly along the second cam groove 13 and the follower pin 18 and the cam follower 14 cause the holder 3 to bring the correction ribbon 6 into its position facing the paper on the platen 1.

The printing head is actuated to erase the erroneously written letter while the correction ribbon 6 is held in its lifted operative position by virtue of the presence of the intermediate portion 113 of equal radius of the second cam groove 13.

Still further rotation of the cam 11 causes the downward movement of the follower pin 18 along the second cam groove 13. When passing through the common ending zone 313 of the two cam grooves 12 and 13, the follower pin 18 moves to the right in FIG. 5 along the bottom of the common ending zone 313 by overcoming the force of the spring 20, and returns to its home position as shown by the solid line in FIG. 3.

The downward movement of the follower pin 18 causes the cam follower 14 and the holder 3 to return to their respective lowered inoperative positions and thereby the correction ribbon 6 on the holder 3 to its inoperative position as shown in FIG. 1.

As is obvious from the foregoing, the first cam groove 12 for lifting the printing ribbon 34 and the second cam groove 13 for lifting the correction ribbon 6 are both formed in a single ribbon lift cam 11, and only a single cam follower 14 is, therefore, required for the cam 11. These features provide a simple arrangement for the selective positioning of the two ribbons 6 and 34.

The cam 11 is rotatable only in one direction and the actuation of the electromagnet 23 is all that is required for the selective engagement of the follower pin 18 in the cam grooves 12 and 13. These features simplify the construction of the ribbon lift mechanism and its control.

Figure 5:
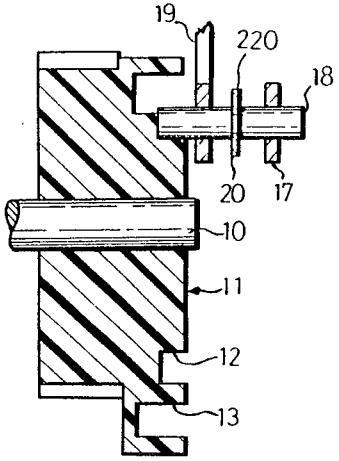
FIG. 5 is an enlarged cross sectional view of the ribbon lift cam.

The beginning zone 212 of the first cam groove 12 has a relatively large arcuate length as is obvious from FIGS. 3 and 5. Even if the holder 3 may be tilted upwardly inadvertently when the follower pin 18 stays in its home position shown by the solid line in FIG. 3, therefore, the follower pin 18 is raised merely within the zone 212 of the first cam groove 12. There is no fear of the pin 18 entering the beginning zone 213 of the second can groove 13 erroneously.

While the invention has been described with reference to a preferred embodiment thereof, it is to be understood that variations or modifications may be easily made by anybody of ordinary skill in the art without departing from the spirit and scope of this invention as defined by the appended claims.

What is claimed is:

1. A typewriter ribbon lifting mechanism comprising:

(a) a printing ribbon located in front of a platen;

(b) a correction ribbon located below said printing ribbon;

(c) a holder supporting said printing and correction ribbons, said holder being tiltable to bring said printing and correction ribbons selectively from their inoperative position to their operative position, while said holder is normally held in its inoperative position;

(d) a cam follower secured to said holder and supporting a follower pin axially movably;

(e) a ribbon lift cam which is rotatable only in one direction to cause said cam follower to tilt said holder, said cam having a first cam groove in which said follower pin is engageable to move said holder to bring said printing ribbon into its operative position, a second cam groove in which said follower pin is engagable to move said holder to bring said correction ribbon into its operative opposition, said second cam groove having a portion coinciding with said first cam groove, while the remaining portion of said second cam groove is greater in depth than said first cam groove, and a land provided between the beginning zones of said first and second cam grooves, said land being continuous to the beginning zone of said first cam groove with the same depth as said first cam groove, said follower pin being slidably in contact with said land, and said beginning zone of said first cam groove being contiguous to said beginning zone of said second cam groove but with a different depth;

(f) means provided on said cam: follower for urging said follower pin toward the bottom of said first and second cam grooves; and (g) an electromagnetic operable for causing said cam follower to move said follower pin in the radial direction of said ribbon lift cam into engagement with said second cam groove to effect the correction of printing.

2. A mechanism as set forth in claim 1, wherein said first cam groove has a relatively small depth and extends along the full circumference of said cam, while said second cam groove encircles said first cam groove, has a greater depth than said first cam groove and extends substantially along the full circumference of said cam, each of said cam grooves having a portion of increasing radius starting at a beginning zone, an intermediate portion of equal radius and a portion of decreasing radius terminating at an ending zone, said ending zones of said cam grooves coinciding with each other and having a gradually decreasing depth until they become equal in depth to said beginning zone of said first cam groove.

3. A mechansim as set forth in claim 1, wherein said cam follower comprises a portion secured to said holder, a portion for supporting said follower pin and a portion connecting said portion secured to said holder and said supporting portion and supporting said urging means thereon, said supporting portion having a projection, and said electromagnet being provided with an armature extending from said electromagnet and having an end which is engageable with said projection and is normally urged away from said projection.

* * * * *